US006371381B1

(12) United States Patent
Niwa et al.

(10) Patent No.: US 6,371,381 B1
(45) Date of Patent: Apr. 16, 2002

(54) HEAT GENERATOR FOR VEHICLE

(75) Inventors: Masami Niwa; Shigeru Suzuki; Hidefumi Mori; Tatsuyuki Hoshino, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/674,538

(22) PCT Filed: Jan. 20, 2000

(86) PCT No.: PCT/JP00/00259

§ 371 Date: Jan. 8, 2001

§ 102(e) Date: Jan. 8, 2001

(87) PCT Pub. No.: WO00/53444

PCT Pub. Date: Sep. 14, 2000

(30) Foreign Application Priority Data

Mar. 5, 1999 (JP) ..... 11-058830

(51) Int. Cl.[7] ..... B60H 1/02

(52) U.S. Cl. ..... 237/12.3 R; 122/26; 126/247

(58) Field of Search ..... 237/12.3 R, 12.3 B; 122/26; 126/247; 123/142.5 R

(56) References Cited

U.S. PATENT DOCUMENTS 5,743,467 A * 4/1998 Ban et al. ..... 237/12.3 R
5,842,636 A * 12/1998 Moroi et al. ..... 237/12.3 R

* cited by examiner

*Primary Examiner*—Pamela Wilson
*Assistant Examiner*—Derek S. Boles
(74) *Attorney, Agent, or Firm*—Woodcock Washburn LLP

(57) ABSTRACT

In a heat generator for a vehicle according to the present invention, an operation chamber defined in the heat generator is composed of a heat generation area (7) which receives therein a rotor, a storage area (8) which contains viscous fluid, and a boundary opening (9) of a relatively large surface area, which connects the two areas. The boundary opening is provided with a pair of transfer openings (35A, 35B) in a point-symmetric arrangement with respect to the rotation axis C of the rotor. Guide portions (41A, 41B), each corresponding to each of the openings, are provided in the storage area. With this structure, since at least one of the transfer openings and the guide portion corresponding thereto are located below the surface level L of the viscous fluid regardless of the attachment angle of the heat generator, the exchange and circulation of the viscous fluid can be carried out between the heat generation area and the storage area, in accordance with the rotation of the rotor.

8 Claims, 9 Drawing Sheets

HEAT GENERATOR FOR VEHICLE

TECHNICAL FIELD

The present invention relates to a heat generator, for a vehicle, having an operation chamber defined in a housing, a viscous fluid contained in the operation chamber, and a rotor which is driven and rotated by a drive power supplied from an external drive source.

BACKGROUND ART

German Unexamined Patent Publication 3832966 (DE3832966A1 published on Apr. 5, 1990) discloses a heating system for occupant spaces in power vehicles with liquid-cooled internal combustion engines. The heating system will be briefly discussed below with reference to FIG. 12 which corresponds to FIG. 2 in the German publication.

The heating system has a housing which defines therein a working chamber 48 (corresponding to an operation chamber), a ring chamber 62 (corresponding to a heat receiving chamber) which surrounds the working chamber 48, and a supply chamber 58 in front of and adjacent to the working chamber 48. The supply chamber 58 and the working chamber 48 are almost completely separated from one another by a partition 60. The partition 60 is provided with a throughgoing opening 66 extending therethrough, which connects the working chamber 48 and the supply chamber 58. A connecting passage 68 is formed in the peripheral wall of the housing and at the upper edge of the partition 60 to bypass the upper portion of the partition 60. The throughgoing opening 66 is opened and closed by a lever 72 provided in the supply chamber 58. The lever 72 is biased by a coil spring 73 in a direction to open the opening 66 and is also biased by a bimetallic leaf spring 76 in a direction to close the opening 66. Namely, the open degree of the opening 66 is determined in accordance with a balance, of the biasing forces, between the springs 73 and 76.

The housing rotatably supports a drive shaft 52 at the rear portion of the housing. The drive shaft 52 is provided on its inner end with a wheel 50 (corresponding to a rotor) which is rotatable together with the drive shaft within the working chamber 48, and on the outer end thereof with a belt pulley 44 secured thereto. The belt pulley 44 is functionally connected to an engine of the vehicle through a belt. The working chamber 48 and the supply chamber 58 contain therein a predetermined amount of viscous liquid 78 with which a space defined between the outer peripheral surface 80 of the wheel 50 and the cylindrical inner wall 82 of the working chamber 48 opposed thereto is filled. Note that, as can be seen in FIG. 12, approximately the lower half of the supply chamber 58 whose opening 66 is closed by the lever 72 is filled with the viscous liquid. When the drive force of the engine is transmitted to the drive shaft 52, the wheel 50 is rotated in the working chamber 48, so that the viscous liquid reserved in the space between the outer peripheral surface 80 of the wheel and the cylindrical inner wall 82 of the working chamber is sheared, thus resulting in a generation of heat due to fluid friction. The heat generated in the working chamber 48 is transmitted to the circulation fluid (engine coolant) circulating in the ring chamber 62 through the separation wall of the housing. The heated circulation fluid is supplied to a heat exchanger of a heater for a vehicle to heat a vehicle compartment.

In the heating system mentioned above, the feed-back control of the ability to generate heat is carried out in accordance with the opening or closing operation of the opening 66 by the lever 72 whose position is controlled by the two springs 73 and 76. Concretely, when the high temperature viscous liquid is recovered in the supply chamber 58 from the working chamber 48 through the connecting passage 68, the biasing force of the bimetallic leaf spring 76 overcomes the biasing force of the coil spring 73 due to an increase in the temperature around the spring 76, so that the lever 72 closes the opening 66. Consequently, the supply of the viscous liquid from the supply chamber 58 to the working chamber 48 is suspended and, accordingly, the amount of the viscous liquid in the working chamber 48 is gradually reduced, thus leading to a reduction of the amount of heat generated by the shearing. The tendency of a decrease in temperature of the viscous liquid to be recovered from the working chamber 48 to the supply chamber 58 causes the biasing force of the bimetallic leaf spring 76 to be weakened, so that the lever 72 is moved in a direction to open the opening 66. As a result, the supply of the viscous liquid from the supply chamber 58 to the working chamber 48 starts again and hence the amount of the viscous liquid in the working chamber 48 is increased to thereby increase the amount of heat to be generated.

In order to enable the viscous liquid to flow between the supply chamber 58 and the working chamber 48 to thereby achieve the expected operation and effect of the heating system, it is necessary to mount the heating system to a vehicle body at a correct attachment angle. FIG. 11 schematically shows a cross section of the supply chamber 58 of the heating system. The correct attachment angle refers to an angle at which the opening 66 is always below the surface level L of the viscous liquid within the supply chamber 58 and the connecting passage 68 is located above the surface level L. This positional relationship between the opening 66, the passage 68 and the surface level L is a necessary condition to ensure that the opening 66 functions as a viscous fluid supply passage and that the connecting passage 68 functions as a viscous liquid recovery passage, respectively. Note that the sufficient condition to cause the movement of the viscous liquid from the supply chamber 58 to the working chamber 48 through the opening 66 is the surface level L of the viscous liquid in the supply chamber 58 being higher than the surface level of the viscous liquid in the working chamber 48. Namely, in the heating system, the drive force to move the fluid relies only upon the difference in the surface level between the two chambers 58 and 48.

However, if the heating system must be always attached to the vehicle body so as to meet the above-mentioned positional relationship of the opening 66 and the connecting passage 68, the attachment angle of the heating system has a certain limit. Namely, as shown in FIG. 11, an ideal attachment angle of the heating system is an angle (upright position) at which an imaginary plane P including the opening 66 and the connecting passage 68 is perpendicular (normal) to the surface level L, and an allowable inclination of the heating system is approximately in the range of ±70 degrees with respect to the upright position. Namely, the allowable attachment angle range of the heating system is limited to approximately 140 degrees about the axis C. Taking into account a possible inclination of the vehicle body itself in forward/rearward and right/left directions, the allowable attachment angle range would be smaller than 140 degrees to practically guarantee reliable operation. In the structure in which, assuming that the opening 66 and the connecting passage 68 function only as a viscous liquid supply passage and only as a viscous liquid recovery passage, respectively, in connection with other elements or members (lever 72, etc.), the single supply passage and the single recovery passage are provided, there is a drawback that the allowable attachment angle of the heating system (heat generator) is very narrow, as mentioned above, and this is not necessarily convenient for a user (car maker, etc.).

DISCLOSURE OF THE INVENTION

It is an object of the present invention to provide a heat generator for a vehicle in which an allowable attachment angle range of a heat generator body is increased in comparison with the prior art, the freedom of attachment to the vehicle body is enhanced, and the attachment can be facilitated.

According to the present invention, there is provided a heat generator for a vehicle comprising an operation chamber defined in a housing, viscous fluid contained in the operation chamber, and a rotor which is driven and rotated by an external drive source, characterized in that said operation chamber is comprised of a heat generation area in which said rotor is housed so as to define a liquid-tight space between a demarcation wall of the operation chamber and the rotor, so that the viscous fluid contained in the liquid-tight space is sheared, to generate heat, by the rotor, a storage area in which the viscous fluid flowing in the volume of the liquid-tight space is stored, and a boundary opening formed at a boundary between the heat generation area and the storage area to connect the heat generation area and the storage area, said boundary opening having an opening area large enough to permit the viscous fluid in the storage area to flow therethrough in accordance with the rotation of the rotor in the heat generation area; said boundary opening is provided with a plurality of transfer openings which constitute a part of the boundary opening and which permit the viscous fluid to move between the storage area and the heat generation area, said transfer openings being spaced from one another so that at least one of the transfer openings is located at a level identical to or below a surface level of the viscous fluid flowing in the storage area during the rotation of the rotor, when the heat generator is mounted to a vehicle body at an allowable attachment angle; said storage area is provided with a guide portion corresponding to each of the transfer openings to change the direction of the viscous fluid flow in the storage area to thereby introduce the viscous fluid into the heat generation area through the transfer openings, whereby the transfer opening which is located at the same level as or below the surface level of the viscous fluid flowing in the storage area and the corresponding guide portion provide a supply passage for the viscous fluid from the storage area to the heat generation area, and the remaining portion of the boundary opening other than the transfer opening which provides the supply passage provides a recovery passage of the viscous fluid from the heat generation are to the storage area, so that the exchange and circulation of the viscous fluid between the two areas can be carried out.

With this structure, since the boundary opening at the boundary between the heat generation area and the storage area is provided with a plurality of spaced transfer openings, at least one of the transfer openings is located at a level equal to or below the surface level L of the viscous fluid which moves in the storage area during the rotation of the rotor, as long as the heat generator is attached to the vehicle body at an allowable attachment angle. Consequently, the guide portion corresponding to the transfer opening that is located at a level identical to or below the surface level L is also located below the surface level L, so that the function to change the flow direction of the viscous fluid in the storage area to thereby introduce the viscous fluid into the heat generation area through the transfer opening can be achieved. Therefore, the transfer opening and the guide portion corresponding thereto, that are located at a level identical to or below the surface level L of the viscous fluid which moves in the storage area cooperate to provide a supply passage of the viscous fluid from the storage area to the heat generation area. The remaining portion of the boundary opening other than the transfer opening that constitutes the supply passage has no guide portion which corresponds thereto, and is located below the surface level L and achieves the function to change the flow direction of the viscous fluid in the storage area. In particular, the guide portions corresponding to the transfer openings other than the transfer opening that defines the supply passage, are not below the surface level L, and accordingly cannot positively achieve the function to change the flow direction of the viscous fluid. Therefore, the remaining portion of the boundary opening other than the transfer opening that constitutes the supply passage negatively provides a recovery passage of the viscous fluid from the heat generation area to the storage area. Thus, the supply passage and recovery passage of the viscous fluid are provided between the heat generation area and the storage area of the operation chamber, and the flow direction of the viscous fluid which is moved and rotated in the storage area, in accordance with the rotation of the rotor provided in the heat generation area is changed by the guide portions located below the surface level L, so that the delivery force of the viscous fluid is produced, thus resulting in the exchange and circulation of the viscous fluid between the heat generation area and the storage area of the operation chamber.

As may be seen from the foregoing, the necessary condition to ensure the exchange and circulation of the viscous fluid is to locate at least one of the plural transfer openings which constitute a part of the boundary opening at a level not higher than the surface level L. In this connection, according to the present invention, the plural transfer openings are spaced from one another in the way mentioned above, so that the probability that at least one of the transfer openings is located at or below the surface level L if the attachment angle of the heat generator to the vehicle body is variously varied can be increased. This means that the allowable attachment angle range of the heat generator can be enlarged. Consequently, with this structure, if the amount of the viscous fluid is limited to the extent that the surface level L lies in the storage area of the operation chamber, taking into account the thermal expansion of the viscous fluid in the operation chamber due to the shearing and heating, it is possible to increase the allowable attachment angle range of the heat generator in comparison with the prior art while ensuring the reliable exchange and circulation of the viscous fluid between the heat generation area and the storage area of the operation chamber. Consequently, not only can the freedom of the attachment of the heat generator to the vehicle body be enhanced but also the attachment operation can be conveniently carried out.

Note that, since the heat generation area and the storage area are interconnected by a boundary opening having a relatively large opening area, the surface level of the viscous fluid in the heat generation area is identical to the surface level L of the viscous fluid in the storage area at least at the stoppage of the rotor, so that there is basically no difference in the surface level between the two areas. Nevertheless, the viscous fluid is moved from the storage area to the heat generation area due to the presence of the guide portions provided in the storage area. In this point, the principle of the heat generator of the present invention is fundamentally distinguished from that of the prior art (heater assembly). The main purpose of the exchange and circulation of the viscous fluid in the heat generator of the present invention is to prevent or delay the deterioration of the viscous fluid.

BEST MODE FOR CARRYING OUT THE INVENTION

Figure 1:
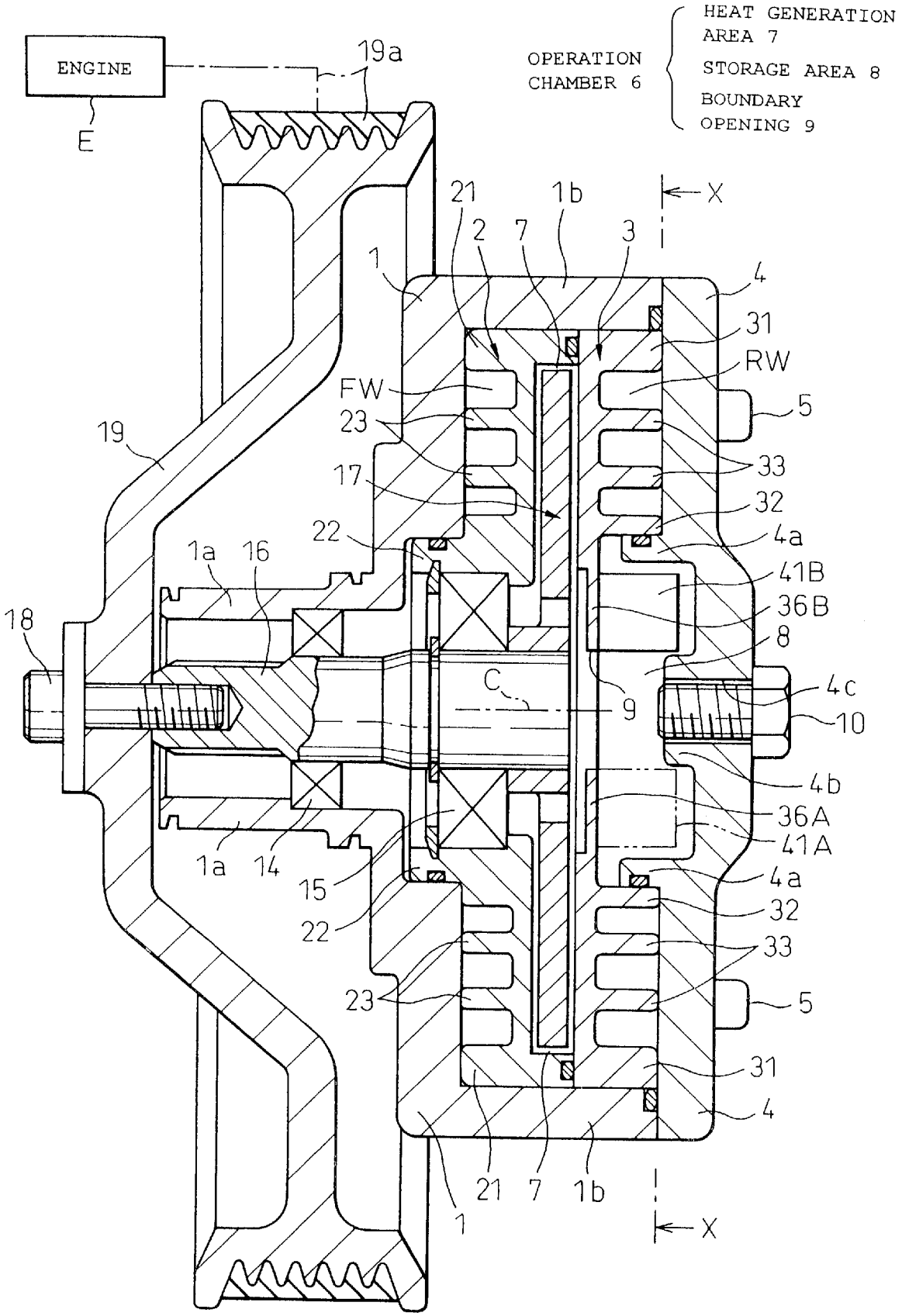
FIG. 1 is a longitudinal sectional view of a heat generator for a vehicle according to an embodiment of the present invention.

An embodiment of a heat generator for a vehicle, according to the present invention, will be discussed below with reference to FIGS. 1 through 9. As shown in FIG. 1, the heat generator is comprised of a front housing body 1, a front demarcation plate 2, a rear demarcation plate 3, and a rear housing body 4. The elements 1 through 4 constitute a housing assembly of the heat generator.

The front housing body 1 is provided with a hollow cylindrical boss 1*a* which protrudes forward (leftward in FIG. 1), and a cylindrical portion 1*b* which extends rearward in the form of a cup from the base end of the boss 1*a*. The rear housing body 4 is in the form of a cover which closes the open end of the cylindrical portion 1*b*. The front housing body 1 and the rear housing body 4 are interconnected by means of a plurality of bolts 5, so that the front demarcation plate 2 and the rear demarcation plate 3 are housed in the cylindrical portion 1*b* of the front housing body. The front demarcation plate 2 and the rear demarcation plate 3 are respectively provided on their outer peripheral portions with annular rims 21 and 31. The rims 21 and 31 are held between the housing bodies 1 and 4 which are interconnected by the bolts 5, so that the demarcation plates 2 and 3 are immovably held in the housing bodies 1 and 4.

The rear end of the front demarcation plate 2 is recessed with respect to the rim 21 to define a heat generation area 7 of an operation chamber 6 between the front and rear demarcation plates 2 and 3. The front demarcation plate 2 defines an end surface (rear end face) 24 corresponding to the bottom surface of the recessed portion, at the rear end of the plate 2 (see FIG. 4). The end surface 24 serves as a separation wall which defines the operation chamber 6. As shown in FIG. 1, the front demarcation plate 2 is provided on its front end with a support cylinder portion 22 at the center thereof, and a plurality of coaxial guide fins 23 which extend concentrically arcuate in the circumferential direction along the outer peripheral surface of the support cylinder portion 22. The front demarcation plate 2 is fitted in the front housing body 1 with the support cylinder portion 22 being partly in close contact with the inner wall portion of the front housing body 1. Consequently, a front water jacket FW as a heat receiving chamber adjacent to the front side of the heat generation area 7 of the operation chamber 6 is defined between the inner wall of the front housing body 1 and the body portion of the front demarcation plate 2. In the front water jacket FW, the rim 21, the support cylinder portion 22 and the guide fins 23 serve as a guide wall to guide the flow of circulation water (e.g., engine coolant) as circulation fluid and establish a passageway for the circulation water in the front heat receiving chamber FW.

Figure 2:
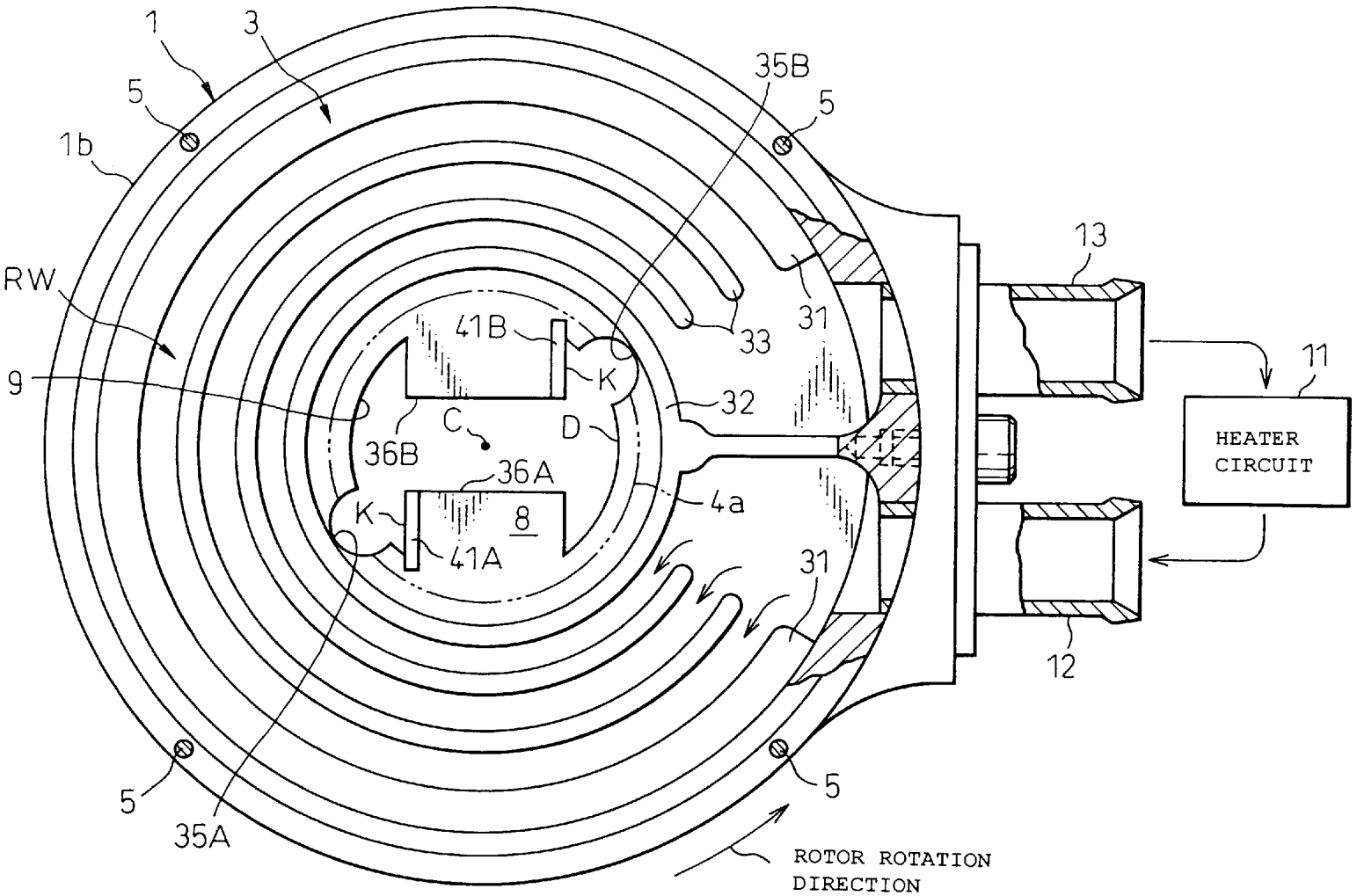
FIG. 2 is a cross sectional view taken along the line X—X in FIG. 1.

As shown in FIGS. 1 and 2, the rear demarcation plate 3 is provided, in addition to the rim 31, with a cylindrical portion 32 formed at the center thereof, and a plurality of coaxial guide fins 33 which extend concentrically arcuate in the circumferential direction along the outer peripheral surface of the cylindrical portion 32. When the rear demarcation plate 3 is held, together with the front demarcation plate 2, between the front and rear housing bodies 1 and 4, the cylindrical portion 32 of the rear demarcation plate 3 is in close contact with an annular wall 4*a* of the rear housing body 4. Consequently, a rear water jacket RW as a heat receiving chamber adjacent to the rear side of the heat generation area 7 of the operation chamber 6, and a storage area 8 of the operation chamber 6 in the cylindrical portion 32 are defined between the body portion of the rear demarcation plate 3 and the rear housing body 4. In the rear water jacket RW, the rim 31, the cylindrical portion 32 and the guide fins 33 serve as a guide wall to guide the flow of circulation water as circulation fluid and establish a passageway of the circulation water in the rear heat receiving chamber FW. The rear demarcation plate 3 defines an end surface (front end face) 34 at the front end of the plate 3 (see FIG. 5). The end surface 34 serves as a separation wall which defines the operation chamber 6.

As can be seen in FIG. 2, the side wall of the front housing body 1 is provided with an introduction port 12 which is adapted to introduce the circulation water from a heater circuit 11 of an air conditioner provided in the vehicle into the front and rear water jackets FW and RW, and a discharge port 13 through which the circulation water is discharged from the front and rear water jackets FW and RW into the heater circuit 11. The introduction port 12 and the discharge port 13 are juxtaposed. The circulation water is circulated between the water jackets FW, RW of the heat generator and the heater circuit 11 through the ports.

As shown in FIG. 1, the front housing body 1 and the front demarcation plate 2 rotatably support a drive shaft 16 through a bearing 14 and a sealed bearing 15. The sealed bearing 15 is arranged between the inner peripheral surface of the support cylinder portion 22 of the front demarcation plate 2 and the outer peripheral surface of the drive shaft 16 to seal the front portion of the heat generation area 7.

Figure 3:
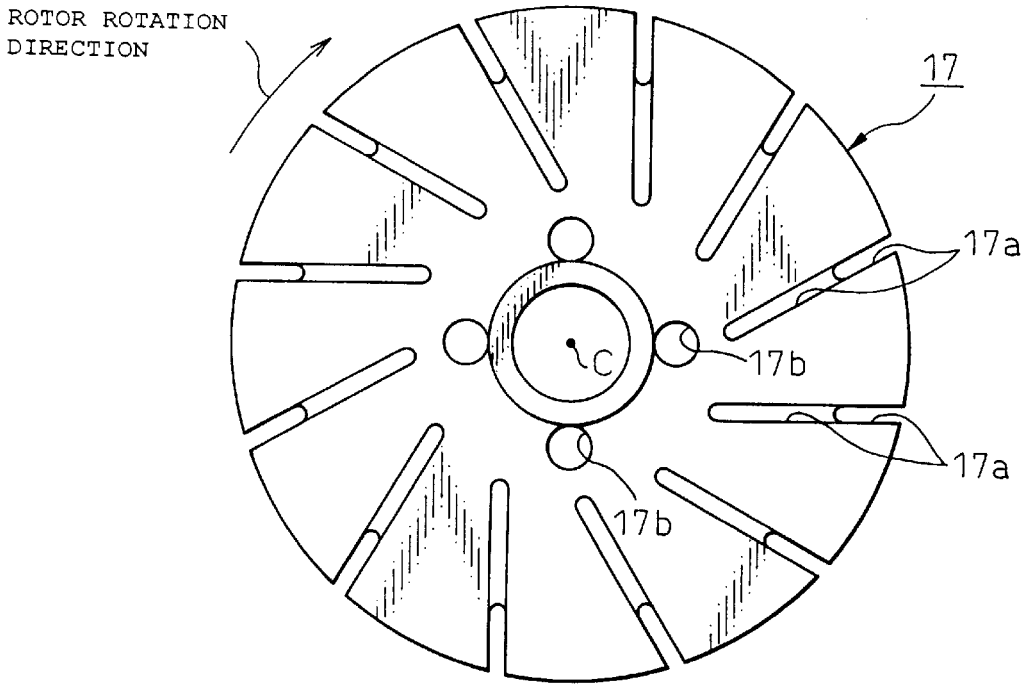
FIG. 3 is an elevational view of a circular disc-like rotor.
Figure 4:
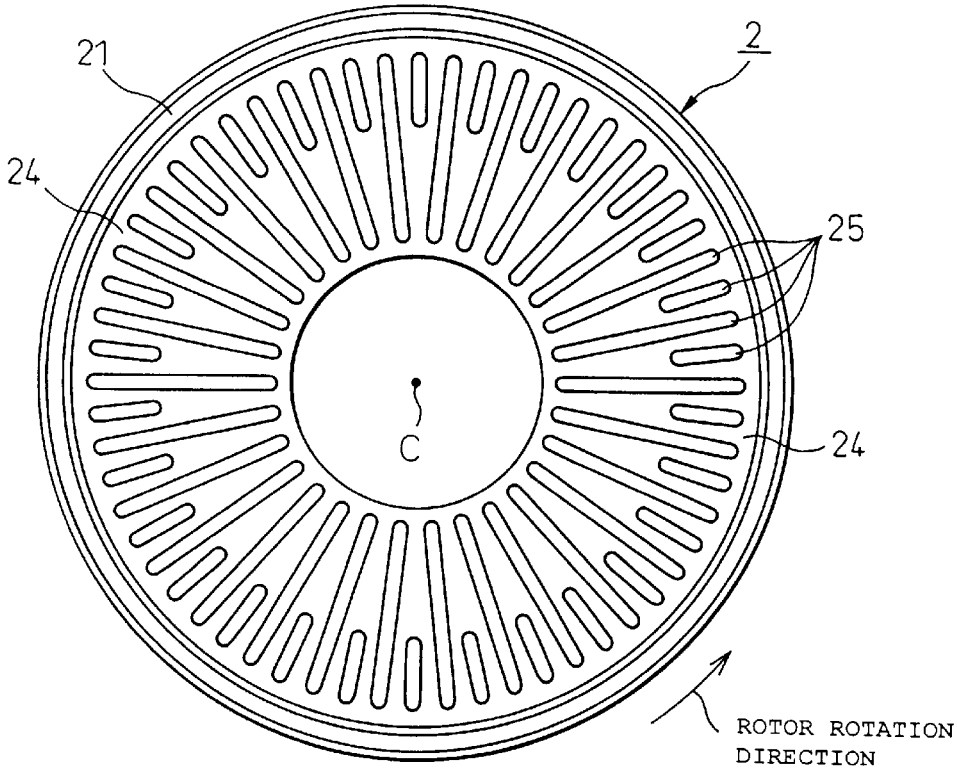
FIG. 4 is an elevational view of a front demarcation plate viewed from a rear end face thereof.

A rotor 17 in the form of a generally circular disc is secured to the rear end of the drive shaft 16 by press-fitting. The rotor 17 is located within the heat generation area 7 in assembling of the heat generator, and defines slight clearances (liquid-tight gaps) between the front end face of the rotor 17 and the rear end face 24 of the front demarcation plate 2 and between the rear end face of the rotor 17 and the front end face 34 of the rear demarcation plate 3, respectively. As shown in FIG. 3, the rotor 17 is provided on its disc plate portion with a plurality of grooved recesses 17*a* which extend radially and slightly obliquely. Each grooved recess 17*a* is in the form of a groove at the center portion and in the form of a slit at the outer peripheral portion. The grooved recesses 17*a* contribute not only to an enhancement of the shearing effect of the viscous fluid within the heat generation area 7 in accordance with the rotation of the rotor 17, but also to the promotion of the movement of the viscous fluid toward the outer peripheral portion of the heat generation area. A plurality of connection holes 17*b* which extend through the rotor body from the front side to the rear side are formed in the vicinity of the center of the rotor 17. The connection holes 17*b* are located at an equal distance from the rotation axis C of the drive shaft 16 and are spaced from one another at an equal angular distance around the drive shaft 16 (or the rotation axis C). The front and rear portions of the heat generation area 7 on opposite sides of the rotor 17 communicate with each other through the connection holes 17*b* to facilitate the movement of the viscous fluid.

As can be seen in FIG. 1, a pulley 19 is secured to the front end of the drive shaft 16 by a bolt 18. The pulley 19 is functionally connected to a vehicle engine E as an external drive source through a power transmission belt 19*a* wound about the outer periphery of the pulley 19. Consequently, the rotor 17 is driven and rotated through the pulley 19 and the drive shaft 16 in accordance with the drive of the engine E.

The front demarcation plate 2, the rear demarcation plate 3, the rotor 17, the heat generation area 7 and the storage area 8 are of a circular-shape in a cross section normal to the rotation axis C, having the center located on the rotation axis C.

Figure 5:
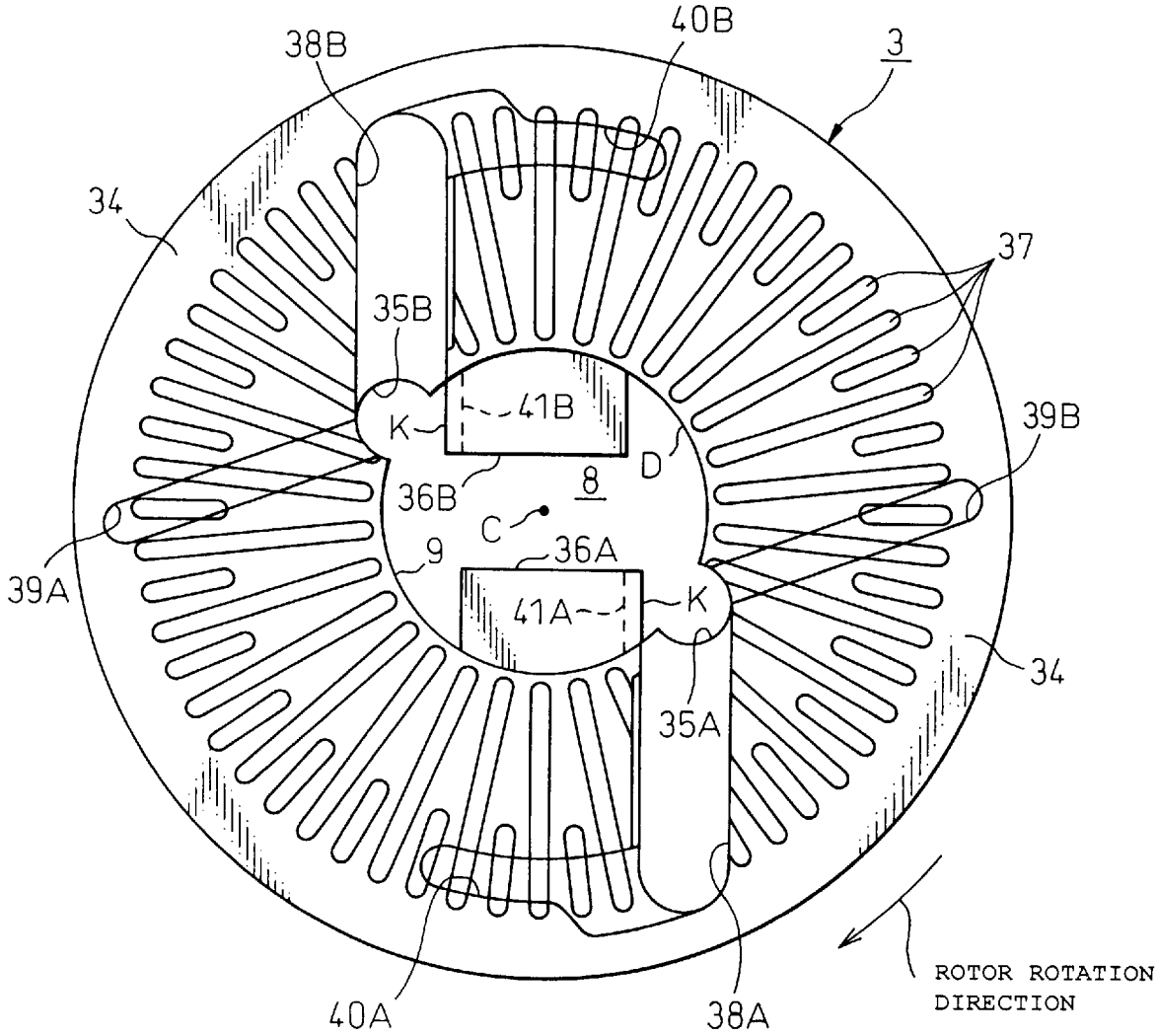
FIG. 5 is an elevational view of a rear demarcation plate viewed from a front end face thereof.

As may be seen in FIGS. 1, 2 and 5, a boundary opening 9 is formed at the center portion of the rear demarcation plate 3 to connect the heat generation area 7 and the storage area 8 at the boundary thereof. The heat generation area 7, the storage area 8 and the boundary opening 9 define the operation chamber 6 which contains therein a predetermined amount of silicone oil as viscous fluid. The amount of the silicone oil will be discussed hereinafter.

The outline of the boundary opening 9 extends substantially along a partial circle D of a predetermined radius, whose center is located on the rotation axis C. Two substantially semi-circular transfer openings 35A and 35B are formed on the rear demarcation plate 3 by cutting way the outside portions of the partial circle D, so that the openings are protruded outward from the partial circle D. The openings 35A and 35B are located in a substantially point-symmetric arrangement with respect to the rotation axis C. Moreover, two substantially square projection walls 36A, 36B are formed on the inner peripheral surface of the cylindrical portion 32 of the rear demarcation plate 3. The projection walls 36A, 36B are located in a substantially point-symmetric arrangement with respect to the rotation axis C and protrude toward the rotation axis C close to each other. The projection walls 36A and 36B are provided with side edges k adjacent to the transfer openings 35A and 35B, respectively. The side edges k of the projection walls 36A and 36B serve as a guide or viscous fluid guide means to change the flow direction of the silicone oil to thereby introduce the oil into the heat generation area 7 through the transfer openings. The length of projection of the projection walls 36A and 36B is smaller than the radius of the partial circle D so that there is a space between the projection walls 36A and 36B. Since the projection walls 36A and 36B are generally square-shaped, the boundary opening 9 exhibits a generally H-shape defined by the partial circle D and the two projection walls 36A and 36B, as viewed from the front or rear side, as can be seen in FIGS. 2 and 5. Namely, the boundary opening 9 consists of a pair of transfer openings 35A, 35B and a generally H-shaped remaining opening portion. The opening area of the generally H-shaped opening portion of the boundary opening 9 is determined such that the silicone oil in the storage area 8 can be rotated and moved to the heat generation area 7 in accordance with the rotation of the rotor in the heat generation area 7. That is, the storage area 8 opens into (or is exposed to) the rear end face of the rotor 17 provided in the heat generation area 7 through the boundary opening 9.

Note that when a predetermined amount of silicone oil (viscous fluid) is contained in the operation chamber 6, the portion of the generally H-shaped opening portion of the boundary opening 9 that is located below the surface level L (FIG. 6) substantially provides a rotation transmission liquid phase portion which exerts the influence, to the silicone oil in the storage area 8 from the silicone oil in the heat generation area 7 to thereby enable the silicone oil to rotate in accordance with the rotation of the rotor 17. In order to increase the cross-sectional of the rotation transmission liquid phase portion in a cross section normal to the rotation axis to thereby enhance the transmission efficiency at the rotation transmission liquid phase portion, the radius of the partial circle D of the boundary opening 9 is preferably within the range of 3/10 to 5/10 of the radius of the rotor 17, and is more preferably identical to approximately 4/10 thereof.

As can be seen in FIG. 1, the center portion of the rear housing body 4 is protruded rearward to increase the volume of the storage area 8 as much as possible and is provided on its center with a central projection 4*b* which projects forward into the storage area 8 from the front surface of the housing body 4. The central projection 4*b* is provided with a supply port 4*c* extending therethrough to connect the storage area 8 to the outside. The supply port 4*c* is adapted to introduce the silicone oil into the operation chamber 6 (areas 7, 8, 9) using an introduction device (not shown) and is closed by a bolt 10 through a seal washer after the oil supply is completed. Note that the rear half of the storage area 8 defines an annular recess defined by the inner peripheral surface of the annular wall 4*a*, the outer peripheral surface of the central projection 4*b* and the front face of the rear housing body 4.

As shown in FIGS. 1, 2 and 5, in addition to the side edges k of the projection walls 36A and 36B, a pair of collision plates 41A and 41B, as a plurality of guide portions, are provided in the storage area 8. The collision plates 41A and 41B are arranged in point-symmetry with respect to the rotation axis C. The collision plates 41A and 41B project rearward from the side edges k adjacent to the transfer openings of the projection walls 36A and 36B, at the rear end faces (adjacent to the storage area 8) thereof. The side edges k adjacent to the transfer openings of the projection walls 36A and 36B are located downstream from the corresponding transfer openings 35A and 35B, for the silicone oil flowing in the storage area 8. The collision plates 41A and 41B extend in the direction of the extension of the corresponding supply grooves 38A and 38B (FIG. 5) and have a length in the axial direction, slightly smaller than the axial length of the storage area 8, so that the rear ends of the collision plates extend slightly into the annular recess, as shown in FIG. 1. The silicone oil which is rotated in the direction of rotation of the rotor, in accordance with the rotation of the rotor 17 within the storage area 8, collides with the collision plates and the flow direction is changed to the axial direction along the associated collision plate so that the silicone oil is forcedly fed toward the corresponding transfer opening. Namely, collision plates 41A and 41B also serve as guides or viscous fluid guide means for changing the flow direction of the silicone oil within the storage area 8 when the silicone oil collides with the collision plates to feed the oil to the heat generation area 7 through the transfer opening. The collision plates assist the function of the side edges k of the projection walls 36A and 36B.

As can be seen in FIG. 5, the rear demarcation plate 3 is provided on its front end surface 34 with a number of effect enhancing grooves 37 which extend radially with respect to the rotation axis C. The effect enhancing grooves 37 are formed so that the length of the adjacent grooves alternately changes and the distance between the adjacent grooves 37 is relatively small at the outer peripheral portion of the heat generation area 7. The effect enhancing grooves 37 enhance the shearing effect of the silicone oil by the rotor 17, depending on the liquid-tight gap of the heat generation area 7, and increase the heat transmission surface area to thereby enhance the heat transmission efficiency from the heat generation area 7 to the heat receiving chambers FW and RW. Also, a number of effect enhancing grooves 25, similar to the effect enhancing grooves 37 are provided on the rear end surface 24 of the front demarcation plate 2. The effect enhancing grooves 25 have the same function as that of the effect enhancing grooves 37.

As can be seen in FIG. 5, the rear demarcation plate 3 is provided on its front end face 34 with two supply grooves 38A and 38B and two recovery grooves 39A and 39B. The two supply grooves 38A and 38B are located in a point-symmetric arrangement with respect to the rotation axis C. The same is true for the two recovery grooves 39A and 39B. The supply grooves and the recovery grooves are provided one for each of the transfer openings 35A and 35B. Namely, for the transfer opening 35A, the supply groove 38A is inclined forward in the direction of rotation of the rotor and is connected to the opening 35A, and the recovery groove 39B is inclined rearward in the direction of rotation of the rotor and is connected to the opening 35A. Likewise, the supply groove 38B and the recovery groove 39A are connected to the transfer opening 35B. The supply grooves 38A and 38B are adapted to introduce the silicone oil discharged from the storage area 8 through the corresponding transfer openings into the outer peripheral portion of the heat generation area 7. The recovery grooves 39A and 39B are adapted to introduce the silicone oil in the outer peripheral portion of the heat generation area 7 into the corresponding transfer openings.

In addition to the foregoing, the rear demarcation plate 3 is provided, on the front end face 34 thereof, with two auxiliary supply grooves 40A and 40B corresponding to the two supply grooves 38A and 38B. The auxiliary supply grooves 40A and 40B are each bent at the outer end of the corresponding supply groove 38A or 38B in the direction of the rotation of the rotor and extend in the circumferential direction. The auxiliary supply grooves 40A and 40B draw the silicone oil in the liquid-tight space of the heat generation area 7 in accordance with the rotation of the rotor 17 to promote the introduction of the oil into the outer peripheral area of the rotor 17. Note that the relationship of the depths of the four different kinds of grooves formed in the end face 34 of the rear demarcation plate 3, i.e., the effect enhancing grooves 37 (depth d1), the supply grooves 38A and 38B (depth d2), the recovery grooves 39A, 39B (depth d3), and the auxiliary supply grooves 40A, 40B (depth d4) is as follows; $d3=d4<d1<d2$.

The operation chamber 6 defined by the heat generation area 7, the storage area 8 and the boundary opening 9 defines a liquid-tight space in the housing of the heat generator. As mentioned above, a predetermined amount of silicone oil as viscous fluid is contained in the operation chamber 6. The fill rate of silicone oil is determined, by taking into account the thermal expansion of the oil during shearing-heating, so that the fill rate at an ordinary temperature is 40 to 95% of the vacant space of the operation chamber 6. Preferably, the amount of oil is determined so that the surface level L of the oil in the storage area 8 when the rotor 17 is stopped is the same as or above the rotation axis C (FIGS. 6–9). This makes it possible to basically dispose one of the two transfer openings 35A and 35B at a level same as or below the oil surface level L and to dispose the other above the oil surface level L. Consequently, at at least the storage area 8 and the boundary opening 9, a liquid consisting of a silicone oil exists in the lower halves thereof, below the surface level L, and a gas of air or inert gas exists in the upper remaining portion above the surface level L. In this state, it is possible to reserve, in the storage area 8, a considerably larger amount of silicone oil than the capacity of the liquid-tight gap defined between the rotor 17 in the heat generation area 7 and the separation walls 24 and 34 of the operation chamber. Note that when the rotor 17 rotates, the silicone oil in the space of the heat generation area 7 below the surface level L is drawn upward to a level above the surface level L due to its expandability and viscosity, by the rotor 17, so that the oil fills the overall liquid-tight gap uniformly, in spite of the limited fill rate.

Figure 6:
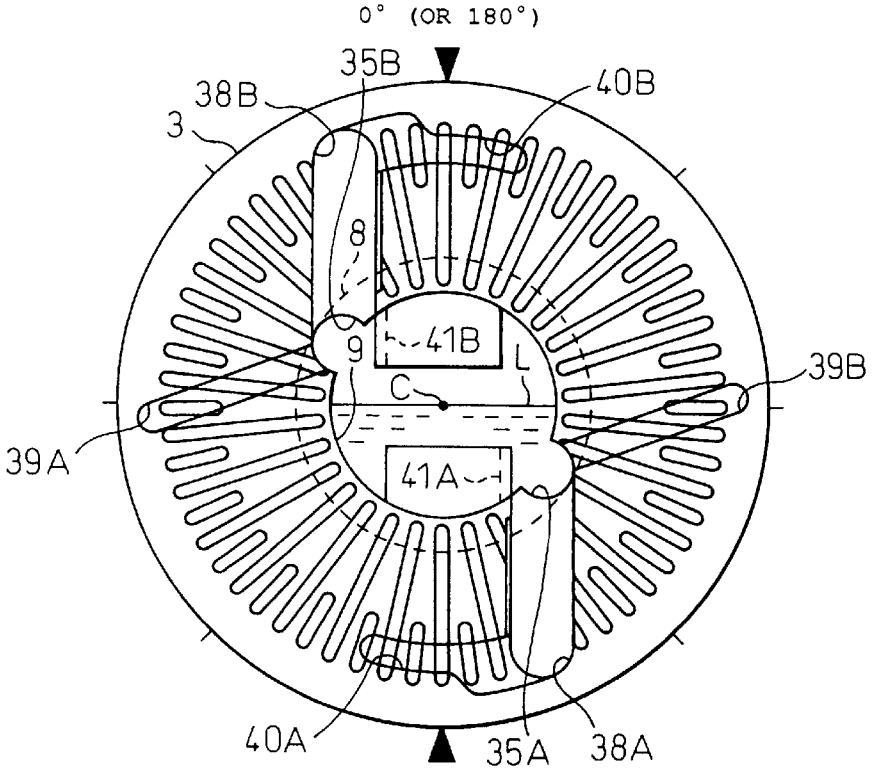
FIG. 6 is an elevational view corresponding to FIG. 5, of a heat generator shown in an upright position.

The basic operation of the heat generator according to the present invention will be discussed below. In the following discussion, it is assumed that the heat generator is attached to the vehicle body in the upright position as shown in FIG. 6. Before the engine E starts, i.e., when the drive shaft 16 is not driven, the surface level L of the silicone oil in the heat generation area 7 of the operation chamber 6 is identical to the surface level in the storage area 8 (see FIG. 6). In this state, the surface contact area of the rotor 17 with the oil is small, and the restraint force of the cold oil to the rotor 17 is relatively small. Therefore, when the engine E starts, the pulley 19, the drive shaft 16 and the rotor 17 can be easily driven with a relatively small torque. In accordance with the rotation of the rotor 17 together with the drive shaft 16, the silicone oil in the liquid-tight gap between the separation walls 24, 34 of the heat generation area 7 and the end face of the rotor 17 is sheared, so that heat is generated. The heat generated in the heat generation area 7 is subject to a heat exchange between the same and the circulation water circulating in the front and rear water jackets FW and RW through the demarcation plates 2 and 3. The circulation water which has been heated during the passage in the water jackets FW and RW is used in the heater circuit 11 to heat the compartment, etc.

In the heat generator, the influence of the rotation of the rotor 17 in the heat generation area 7, i.e., the stirring operation by the rotating rotor 17 is transmitted to the silicone oil in the storage area 8 through the liquid portion of the silicone oil in the lower half of the boundary opening 9. Namely, when the oil in the heat generation area 7 is rotated and moved in accordance with the rotation of the rotor 17, the oil in the storage area 8 is rotated and moved in the same direction. Consequently, almost all of the oil which is moved in the storage area 8 due to the rotation of the rotor 17 collides with the guide portion (i.e., the collision plates 41A and the side edge k of the projection wall 36A) which is located below the oil surface level L and is submerged in the oil, so that the flow direction of the oil is changed and is forced toward the transfer opening 35A corresponding to the guide portion. Namely, the transfer opening 35A located below the oil surface level L provides an oil supply passage connected to the heat generation area 7 from the storage area 8, together with the side edge k of the projection wall 36A and the collision plate 41A. The oil introduced into the heat generation area 7 through the transfer opening 35A is fed uniformly to the liquid-tight gap through the supply groove 38A and is guided into the outer peripheral portion (in which relatively active heat generation takes place) of the heat generation area 7 particularly due to the cooperation of the supply groove 38A and the auxiliary supply passage 40A.

The silicone oil introduced in the overall heat generation area 7 is returned to the storage area 8 through the gas phase portion of the boundary opening 9 above the surface level L. A large part of the oil in the heat generation area 7 is collected by the recovery groove 39A connected to the transfer opening 35B located above the surface level L in accordance with the rotation of the rotor 17 and is returned to the storage area 8 through the transfer opening 35B. Note that, during the rotation of the rotor, the recovery groove 39B connected to the transfer opening 35A located below the surface level L tends to collect the oil from the heat generation area 7 and feed the same to the transfer opening 35A, but since the discharge pressure of the oil flowing into the heat generation area 7 from the transfer opening 35A is remarkably higher than the oil discharge pressure by the recovery groove 39B due to the presence of the collision plate 41A and the side edge k of the projection wall 36A, the recovery groove 39B does not substantially function.

As may be understood from the foregoing, so long as the rotor 17 rotates in the state shown in FIG. 6, the transfer opening 35A below the surface level L functions as an oil supply passage into the heat generation area 7 from the storage area 8 and the transfer opening 35B above the surface level L substantially functions as an oil recovery passage into the storage area 8 from the heat generation area 7. The supply groove 38A and the auxiliary supply groove 40A, that cooperate with the transfer opening 35A as an oil supply passage, can fully achieve their own functions, but the supply groove 38B and the auxiliary supply groove 40B, that do not cooperate with the opening 35A cannot achieve their own functions and are ineffective. Further, the recovery groove 39A that cooperates with the transfer opening 35B as an oil recovery passage can fully achieve its own function, but the recovery groove 39B that cooperates with the transfer opening 35A as an oil supply passage cannot achieve its own function and is ineffective.

In this sense, in the arrangement shown in FIG. 6, the transfer opening 35A below the surface level L and the corresponding guide portion (the side edge k of the projection wall 36A and the collision plate 41A) provide an oil supply passage from the storage area 8 to the heat generation area 7. The remaining portion of the boundary opening 9 (in particular, the other transfer opening 35B which forms a part of the gas phase portion of the boundary opening 9), except for the transfer opening 35A which provides the oil supply passage, provides an oil recovery passage from the heat generation area 7 to the storage area 8. Consequently, so long as the rotor 17 rotates, the circulation/exchange of the silicone oil (viscous fluid) between the heat generation area 7 of the operation chamber 6 and the storage area 8 thereof can be continuously carried out. Note that the silicone oil recovered in the storage area 8 is stored therein for a certain time corresponding to the cycle time of the circulation/exchange of the oil.

The oil immediately after being recovered from the heat generation area 7 has a high temperature, and a part of the heat is transmitted to the defining members of the storage area 8 (the rear demarcation plate 3 and the rear housing body 4) while the oil is stored in the storage area, so that the heat of the silicone oil is removed. Consequently, the high temperature silicone oil is cooled (heat is removed) and can be protected from deterioration due to heat.

The angle which the heat generator can be inclined with respect to the rotation axis C when the heat generator is mounted in the upright position (attachment angle is 0°), so that the collision plates 41A and 41B are perpendicular to the oil surface level L, as shown in FIG. 6, will be analyzed below.

Figure 7:
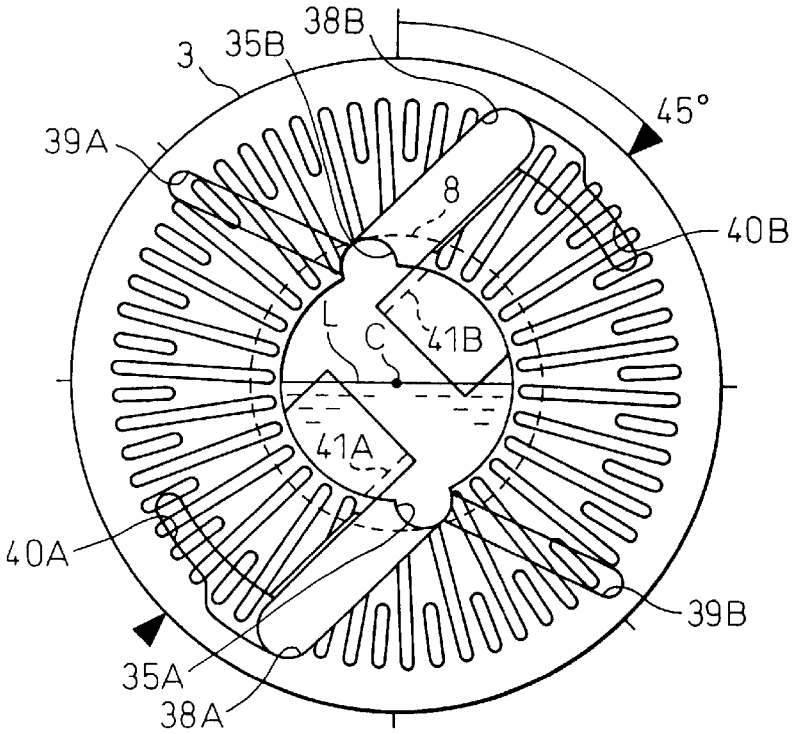
FIG. 7 is an elevational view of a heat generator which is attached at an inclination angle of 45 degrees with respect to the upright position.
Figure 8:
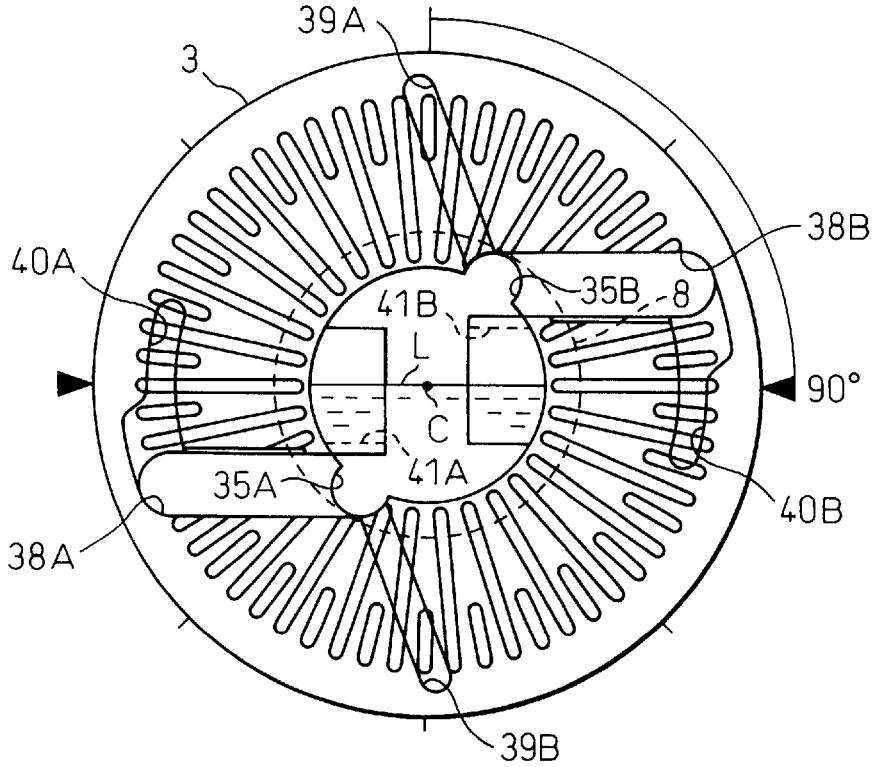
FIG. 8 is an elevational view of a heat generator which is attached at an inclination angle of 90 degrees with respect to the upright position.

FIG. 7 shows a heat generator which is inclined at 45 degrees in the clockwise direction with respect to the upright position shown in FIG. 6. FIG. 8 shows a heat generator which is inclined at 90 degrees in the clockwise direction with respect to the upright position shown in FIG. 6. In FIGS. 7 and 8, the transfer opening 35A and the corresponding guide portion (the side edge k of the projection wall 36A and the collision plate 41A) are located below the surface level L, so that they serve as an oil supply passage and the supply groove 38A and the auxiliary supply groove 40A achieve their functions. The transfer opening 35B located above the surface level L and the recovery groove 39A connected thereto serve as a main oil recovery passage. The remaining recovery groove 39B, the supply groove 38B and the auxiliary supply groove 40B are in ineffective positions. This state is the same as that in FIG. 6, and hence the exchange/circulation of the oil is carried out if the heat generator is inclined at 90 degrees with respect to the upright position.

Figure 9:
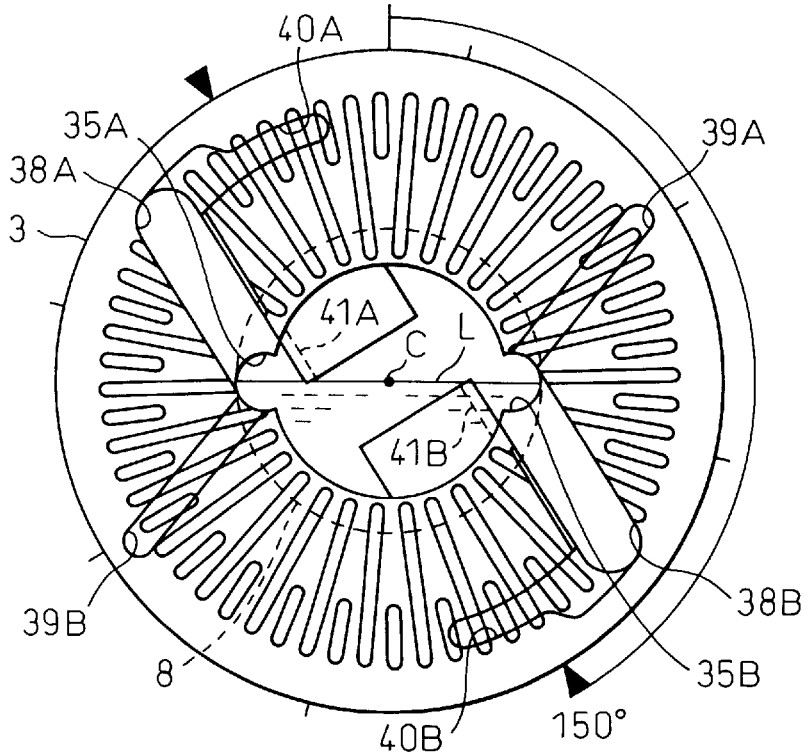
FIG. 9 is an elevational view of a heat generator which is attached at an inclination angle of 150 degrees with respect to the upright position.

FIG. 9 shows a heat generator which is inclined at approximately 150 degrees in the clockwise direction with respect to the upright position shown in FIG. 6. In this position, the upper transfer opening 35A and the lower transfer opening 35B are divided by the surface level L. In FIG. 9, the lower half of the transfer opening 35B and the corresponding guide portion (the side edge k of the projection wall 36B and the collision plate 41B) are located below the surface level L, so that they function as an oil supply passage and the supply groove 38B and the auxiliary supply grove 40B also achieve their own functions. The transfer opening 35A whose upper half is located above the surface level L and the recovery groove 39B connected thereto serve as a main oil recovery passage. This is because the guide portion (side edge k of the projection wall 36A and the collision plate 41A) corresponding to the opening 35A is located above the surface level L and, accordingly, the opening 35A cannot positively serve as an oil supply passage. The remaining recovery groove 39A, the supply groove 38A and the auxiliary supply groove 40A are in ineffective positions. This state is deemed to be essentially identical to the state shown in FIGS. 6 through 8 though the roles of the two transfer openings 35A and 35B are opposite in comparison with the arrangement shown in FIGS. 6 through 8. Therefore, even if the heat generator is inclined upto 150 degrees with respect to the upright position, the oil exchange/circulation function can be reliably achieved.

Moreover, when the heat generator is inclined at 180 degrees with respect to the upright position (FIG. 6), that is, when the heat generator is inverted, the state same as that shown in FIG. 6 is obtained. This is because the side edges k of the pair of projection walls 36A and 36B, the collision plates 41A, 41B, the transfer openings 35A, 35B and the pairs of grooves (38A, 38B; 39A, 39B; 40A, 40B) are arranged in a point-symmetry with respect to the rotation axis C and are identical in shape and size. Namely, to distinguish the equivalent elements in a pair from one another is functionally meaningless, whichever of the transfer openings 35A and 35B serves as an oil supply passage or oil recovery passage. Therefore, when the heat generator is attached in an inverted position, the oil exchange/circulation function is guaranteed. Although the above discussion has been applied to the inclination of the heat generator in the clockwise direction, the same is true when the heat generator is inclined with respect to the upright position shown in FIG. 6 in the counterclockwise direction. Namely, in the heat generator according to the illustrated embodiments, the oil exchange/circulation function achieved when the heat generator is attached in an upright position can be achieved at any oblique attachment angle with respect to the rotation axis C. In other words, the allowable attachment angle of the heat generator is ±180° with respect to the upright position (i.e. is 360°).

The following advantages can be obtained according to the illustrated embodiments of the invention.

According to the heat generator of the present invention, a pair of identical elements (35A, 35B; 41A, 41B; etc.) which are point-symmetrically arranged with respect to the rotation axis C are provided on the rear demarcation plate 3 and it is possible to make the allowable attachment angle range of the heat generator much wider than the prior art without reducing the oil exchange/circulation function, as mentioned above. Moreover, the allowable range of the attachment angle of 360° means that there is no dead angle of the attachment as long as the heat generator is inclined with respect to the center of the rotation axis C. Therefore, the freedom of attachment of the heat generator to a vehicle body is remarkably enhanced, thus leading to an enhanced convenience in the mounting operation.

Since the collision plates 41A and 41B corresponding to the two equivalent transfer openings 35A and 35B are provided in the storage area 8, one of the transfer openings 35A and 35B can be effectively used as an oil supply passage and the other transfer opening can be effectively used as a main oil recovery passage even if the oil surface level L in the storage area 8 is relatively low as shown in FIGS. 6 through 9.

Moreover, in the heat generator, as long as the rotor 17 rotates, the exchange/circulation of the silicone oil can be continuously carried out between the heat generation area 7 and the storage area 8 of the operation chamber 6. Consequently, no specific silicone oil in the heat generation area 7 is always sheared by the rotor 17 and hence the deterioration of the oil is restricted, thus resulting in a prolongation of the service life thereof. Consequently, the exchange cycle of the silicone oil is considerably prolonged and no disassembly/maintenance of the heat generator after it is mounted to the vehicle is necessary (or the number of the disassembly/maintenance operations is reduced), thus resulting in a realization of a convenient supplementary device.

Since the silicone oil in the operation chamber 6 including the storage area 8 is positively stirred by the rotor 17, low temperature-high viscosity oil and high temperature-low viscosity can be easily mixed, so that the temperature and viscosity of the oil in the operation chamber 6 are made uniform. Furthermore, all the silicone oil contained in the operation chamber 6 can be continuously and evenly used. In particular, it is possible to prevent the high temperature oil from being locally collected in the storage area 8.

The embodiments can be modified as follows, according to the present invention.

Although two identical elements, such as the transfer openings 35A and 35B, the projection walls 36A and 36B, or the collision plates 41A and 41B, etc., are provided in the illustrated embodiment, it is possible to provide three or more identical elements.

In the illustrated embodiment, a pair of transfer openings 35A and 35B are in a point-symmetric arrangement with respect to the rotation axis C, that is, the opening 35A, the rotation axis C and the opening 35B define an angle of 180° therebetween, in the illustrated embodiments to obtain the allowable attachment angle of 360°. However, if the allowable attachment angle can be smaller than 360°, the angle defined between the opening 35A, the rotation axis C and the opening 35B may be less than 180° (e.g., approximately 120°). In this alternative, the allowable attachment angle range can be larger than the prior art due to the presence of the plural transfer openings 35A, 35B, etc.

It is possible to provide a stirring means (e.g., a screw) at the rear end of the rotor 17 to positively stir the viscous fluid in the operation chamber 6. Moreover, it is possible to insert the rear end of the rotor 17 having the stirring means into the storage area 8 of the operation chamber 6.

Figure 10:
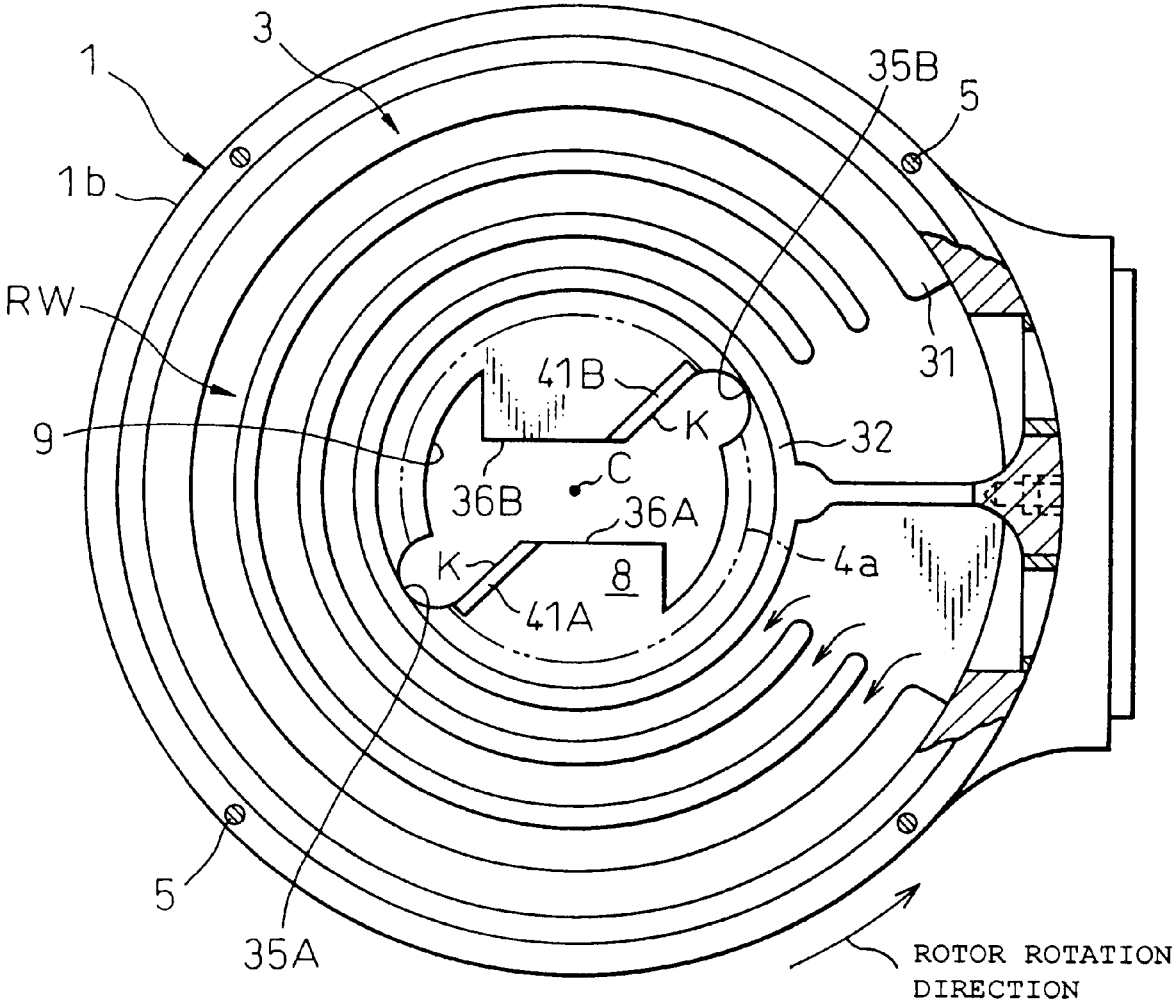
FIG. 10 is a cross sectional view corresponding to FIG. 2, of another embodiment of a collision plate.
Figure 11:
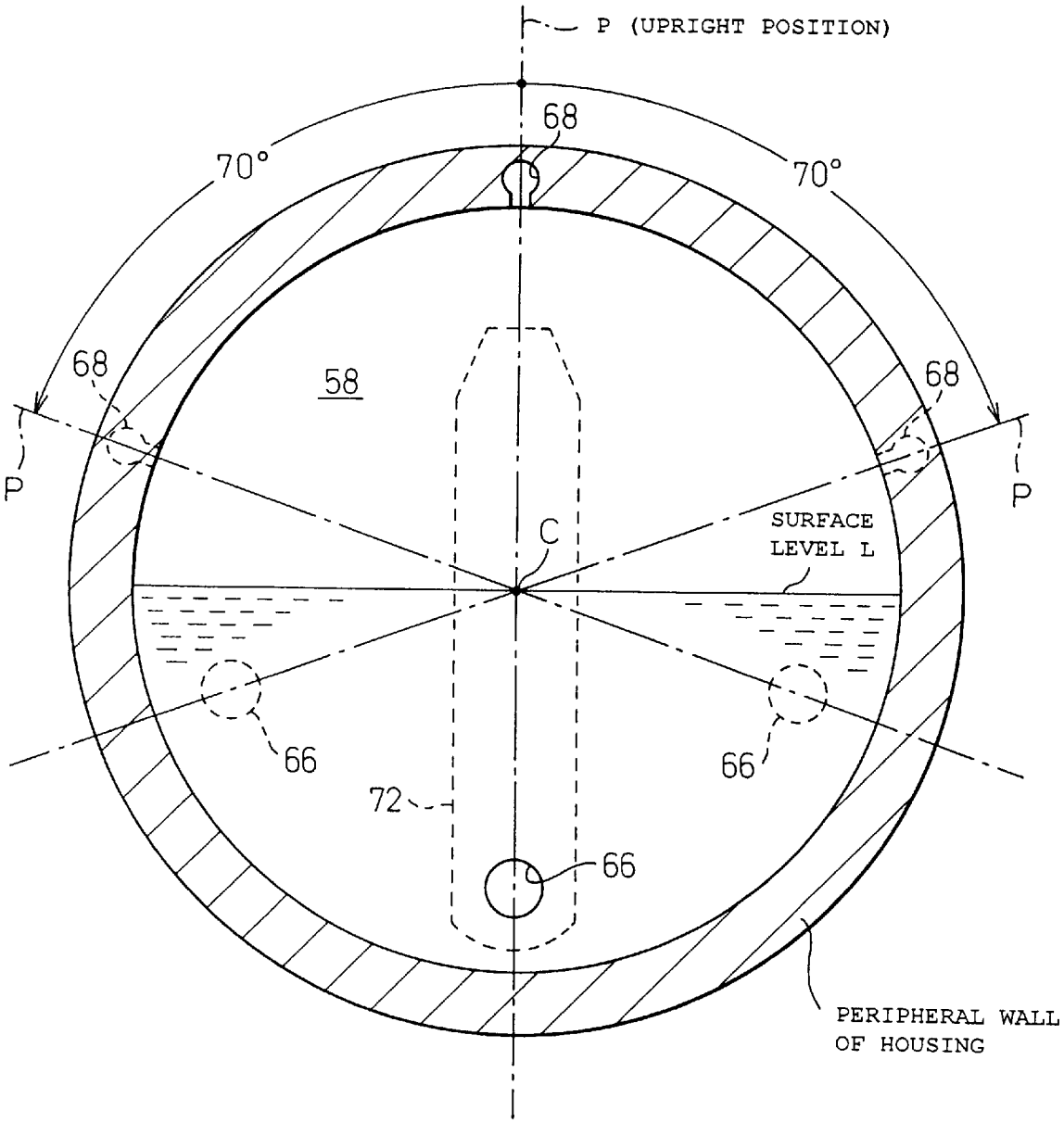
Fig.11 (PRIOR ART)
FIG. 11 is a schematic sectional view showing an allowable attachment angle range in the prior art.
Figure 12:
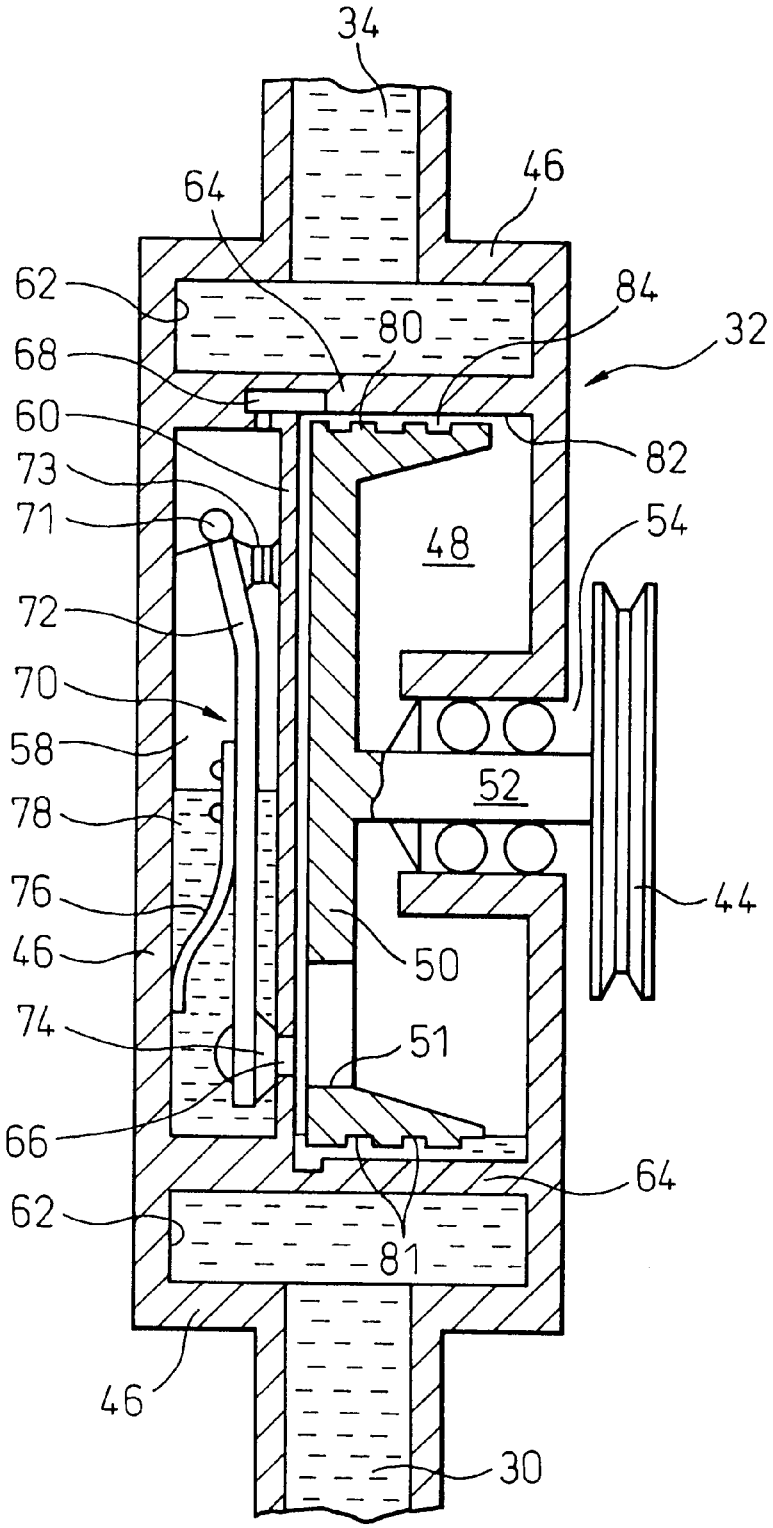
Fig.12 (PRIOR ART)
FIG. 12 is a sectional view of a heating system in the prior art.

Although the collision plates 41A and 41B are formed along the side edges k of the generally square projection walls 36A and 36B, in the illustrated embodiment, an arrangement as shown in FIG. 10 can be adopted. Namely, the design is modified so that the projection walls 36A and 36B are each substantially trapezoidal in front view and the oblique sides of the trapezoids (corresponding to the side edges k) extend substantially along a diametrical line (imaginary line) passing through the rotation axis C. The collision plates 41A and 41B are provided along the oblique sides. The rotation axis C is located substantially on a line connecting the collision plates 41A and 41B. In this modified arrangement, the side edges k of the projection walls 36A, 36B or the collision plates 41A, 41B, that are perpendicular to the flow direction of the silicone oil which is rotated and moved in the storage area obstruct the flow of the oil and change the direction thereof.

Furthermore, the collision plates 41A and 41B are provided on the rear surfaces of the projection walls 36A and 36B of the rear demarcation plate 3 in the embodiment shown in FIG. 10, but it is possible to mount the collision plates 41A, 41B to the front surface of the rear housing body 4, so that the collision plates 41A, 41B are oriented toward the axial and forward direction.

In addition to the foregoing, the collision plates 41A, 41B are provided in the embodiment shown in FIGS. 1 through 5 and in the modified embodiment shown in FIG. 10, but the guide portions can be constituted only by the side edges k of the projection walls 36A and 36B without providing the collision plates.

Note that the expression "viscous fluid" includes any kind of medium that generates heat due to fluid friction when it is subject to a shearing operation by the rotor and is not limited to highly viscous liquid or semifluid and is not limited to silicone oil.

As may be understood from the above discussion, according to the heat generator of the present invention, in an arrangement that the amount of viscous fluid in the operation chamber is limited to a surface level which lies in the storage area of the operation chamber, taking into account a thermal expansion of the viscous fluid when the viscous fluid contained in the operation chamber is subject to a shearing operation and generates heat, the allowable attachment angle range of the heat generator can be made larger than the prior art without having an adverse influence on the exchange/circulation of the viscous fluid between the heat generation area and the storage area of the operation chamber, and thus, the freedom of attachment to a vehicle body can be increased and the mounting operation can be facilitated.

Although the above discussion has been addressed to specific embodiments, the invention can be variously modified by an artisan in the field without departing from the claim and the spirit of the invention.

What is claimed is:

1. A heat generator for a vehicle comprising an operation chamber defined in a housing, viscous fluid contained in the operation chamber, and a rotor which is driven and rotated by an external drive source, characterized in that said operation chamber comprises a heat generation area in which said rotor is housed so as to define a liquid-tight space between a demarcation wall of the operation chamber and the rotor, so that the viscous fluid contained in the liquid-tight space is sheared by the rotor, to generate heat, a storage area in which the viscous fluid flowing through the volume of the liquid-tight space is stored, and a boundary opening formed at a boundary between the heat generation area and the storage area to connect the heat generation area and the storage area, said boundary opening having an opening area large enough to permit the viscous fluid in the storage area to flow therethrough in accordance with the rotation of the rotor in the heat generation area;

said boundary opening is provided with a plurality of transfer openings which constitute a part of the boundary opening and which permit the viscous fluid to move between the storage area and the heat generation area, said transfer openings being spaced from one another so that at least one of the transfer openings is located at a level identical to or below a surface level of the viscous fluid flowing in the storage area during the rotation of the rotor, when the heat generator is mounted to a vehicle body at an allowable attachment angle;

said storage area is provided with a guide portion corresponding to each of the transfer openings to change the direction of the viscous fluid flow in the storage area to thereby introduce the viscous fluid into the heat generation area through the transfer openings, whereby the transfer opening which is located at the same level as or below the surface level of the viscous fluid flowing in the storage area and the corresponding guide portion provide a supply passage of the viscous fluid from the storage area to the heat generation area, and the remaining portion of the boundary opening other than the transfer opening which provides the supply passage provides a recovery passage of the viscous fluid from the heat generation are to the storage area, so that the exchange and circulation of the viscous fluid between the two areas can be carried out.

2. A heat generator for a vehicle according to claim 1, wherein said plural transfer openings are spaced from one another at an equal angular distance around the rotation axis of the rotor and are spaced from the rotation axis at an equal distance.

3. A heat generator for a vehicle according to claim 1, wherein said transfer openings are identical in shape and size.

4. A heat generator for a vehicle according to claim 1, wherein there are two transfer openings which are identical in shape and size and are located in a point symmetric arrangement with respect to the rotation axis of the rotor.

5. A heat generator for a vehicle according to claim 1, wherein said guide portions include collision plates projecting from and provided on demarcation members which define the storage area.

6. A heat generator for a vehicle according to claim 1, wherein the demarcation wall of the operation chamber that is opposed to one end surface of the rotor disposed in the heat generation area of the operation chamber is provided with a supply groove corresponding to each of the transfer openings to guide the viscous fluid introduced in the heat generation area from the storage area through the transfer openings toward the outer peripheral portion of the heat generation area.

7. A heat generator for a vehicle according to claim 1, wherein the demarcation wall of the operation chamber that is opposed to one end surface of the rotor disposed in the heat generation area of the operation chamber is provide with a recovery groove corresponding to each of the transfer openings to guide the viscous fluid from the outer peripheral portion of the heat generation area toward the transfer openings.

8. A heat generator for a vehicle according to claim 1, comprising a plurality of projection walls at a boundary between the heat generation area and the storage area of the operation chamber, said projection walls extending toward the center (C) of the boundary opening, each of the projection walls being provided with a side edge adjacent to the transfer opening corresponding thereto.

* * * * *